US005483763A

United States Patent [19]

Liu

[11] Patent Number: 5,483,763

[45] Date of Patent: Jan. 16, 1996

[54] WATER FILLED CRYSTAL BALL WITH UNDULATING PIVOT ARMS

[76] Inventor: Jian H. Liu, No. 3, Alley 202, Kao Fen Road, Hsin-Chu City, Taiwan

[21] Appl. No.: 235,674

[22] Filed: Apr. 29, 1994

[51] Int. Cl.[6] ..... G09F 19/08

[52] U.S. Cl. ..... 40/414; 40/430; 74/55

[58] Field of Search ..... 446/236, 267, 446/6, 7, 34, 35, 137; 40/414, 430, 435, 406; 74/55

[56] References Cited

U.S. PATENT DOCUMENTS

| | | | |
|---|---|---|---|
| 307,859 | 11/1884 | La Due | 74/55 |
| 1,403,632 | 1/1922 | Recen | 74/55 |
| 2,316,408 | 4/1943 | Dawson | 74/55 |
| 2,689,732 | 9/1954 | Madaloni | 472/7 |
| 2,935,793 | 5/1960 | Herman | 446/236 X |
| 3,975,845 | 8/1976 | Mellard | 40/414 |
| 5,070,633 | 12/1991 | Liu | 40/411 |
| 5,088,218 | 2/1992 | Liu | 40/411 |
| 5,103,770 | 4/1992 | Berkovich | 446/236 X |
| 5,134,795 | 8/1992 | Wang | 40/411 |
| 5,235,865 | 8/1993 | Feng | 40/414 X |

*Primary Examiner*—Brian K. Green
*Assistant Examiner*—Joanne Silbermann
*Attorney, Agent, or Firm*—Larson and Taylor

[57] ABSTRACT

A water filled crystal ball with undulating pivot arms is disclosed. The important parts comprise a central rotating shaft, a bushing, undulating pivot arms, and a rotating disk. It is the rotating motion of the central rotating shaft that is the driving force. It is the outer bushing which is the levering force that causes an up and down undulation of the pivot arms inside the glass sphere of the crystal ball. Decorative objects above the fixed disk are moved by a track which is fixed to the top of a rotating disk and move in a level radial back and forth fashion. This produces a scene in which there are multiple directions of motion of decorative objects within a glass sphere.

8 Claims, 3 Drawing Sheets

WATER FILLED CRYSTAL BALL WITH UNDULATING PIVOT ARMS

FIELD OF THE INVENTION

The present invention relates to a liquid filled crystal ball having an internal object that has motion and in particular relates to a mechanism that produces motion of the internal object.

BACKGROUND OF THE INVENTION

Most of the movements of decorative objects which move in a water filled crystal ball are derived from rotary motion of some kind. A music box shaft located in the base of the ball is the driving force which turns the central shaft. This shaft then gives motion to different decorative objects within the glass sphere. For references see U.S. Pat. Nos. 5,070,633, 5,088,218, and 5,134,795 etc. In general a central rotating shaft is the driving force which imparts a variety of different motions to decorative objects inside the glass sphere of the crystal ball.

SUMMARY OF THE INVENTION

In order to increase the range of motion aspects which can be seen inside the glass sphere of a crystal ball, the applicant for this patent has designed a structure that used an undulating pivot arm within the glass sphere. The main focus is the rotating shaft in the center which acts as the driver. A bush which surrounds the central shaft acts as the fulcrum for the undulating pivot arm which provides the up and down reciprocating or undulating motion.

These construction details in a presently preferred embodiment are for the construction of an undulating pivot arm water filled crystal ball. The main mechanisms include a rotating drive axle, bush, undulating pivot arms, a rotating base plate and other mechanisms. Its driving mechanism is a centrally located rotating drive shaft. The drive shaft works with a bush and acts as a fulcrum for the undulating pivot arms which undulate up and down inside the crystal ball. At the same time decorative objects which move in a variety of different directions.

Furthermore, decorative objects above a fixed disk plate receive a back and forth motion from a closed track fixed to a rotating plate. This too increases the range of motions that can be seen inside the crystal sphere.

DETAIL DESCRIPTION OF THE INVENTION

For detailed construction details and expectations of functionally, please refer to the following diagrams and the attached explanations.

Figure 1:
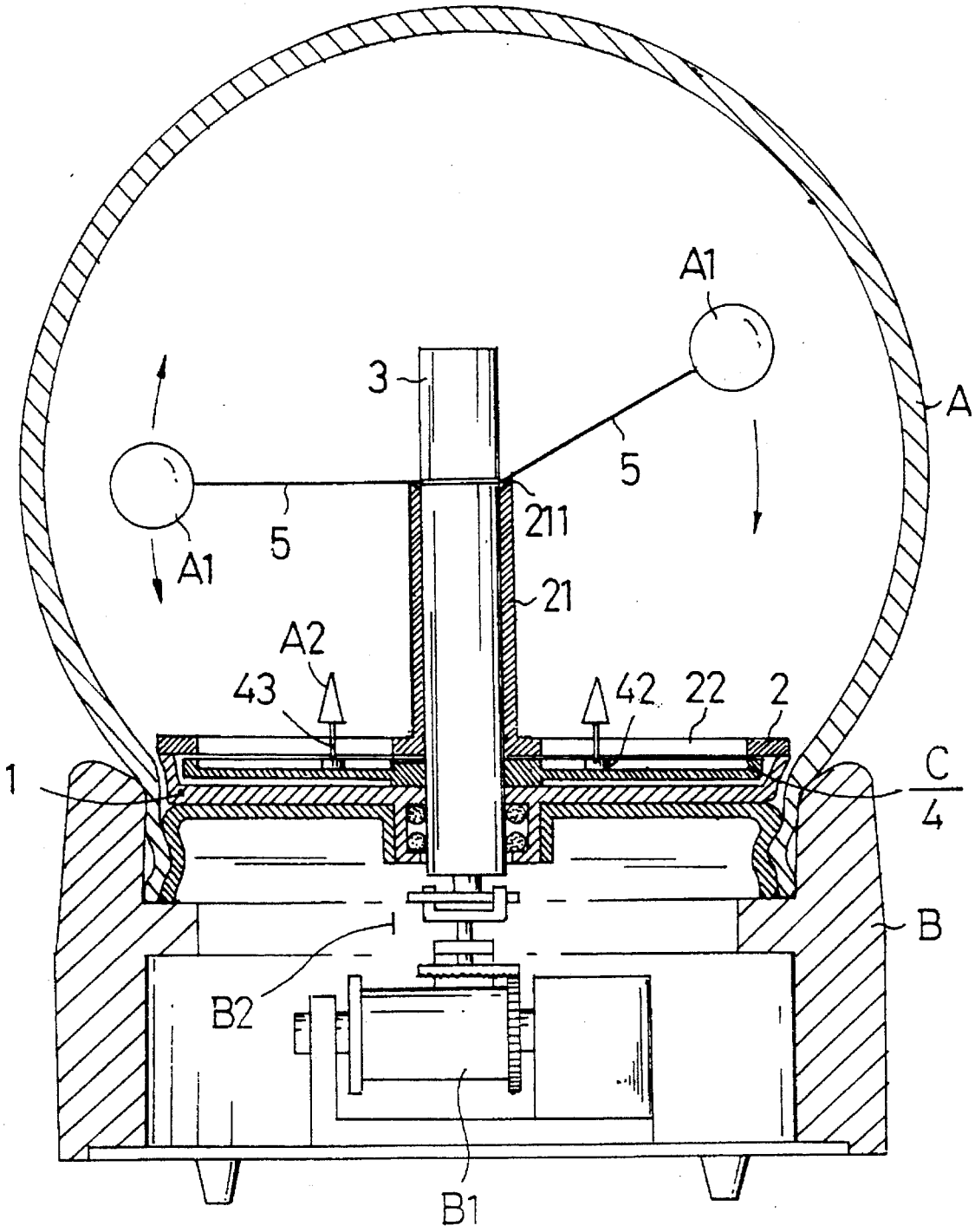
FIG. 1 is an elevational, cross sectional view of a crystal ball, including the glass sphere.

Please refer to FIG. 1. The basic structure of this invention consists of a fixed base (B) and above this fixed base (B) is a glass sphere(A). The above mentioned glass sphere (A) is open at the bottom, and is tightly sealed with a plastic seal. The empty sphere is then filled with distilled water or some other clear liquid. Next, above the aforementioned plastic stopper, is installed a fixed base or fixed disk plate (1). Through the center of this fixed disk plate (1) is placed a vertically oriented rotating central shaft (3). The top end of this rotating shaft (3) is in the glass sphere (A) and the bottom end is placed in the base unit (B). The space between the aforementioned rotating shaft (3) and the surrounding fixed base sleeve will use one, two or more O-rings, which will allow the central shaft to rotate within the bush, while preventing the liquid from leaking out.

Furthermore, in the base (B) there is a spring loaded winding mechanism which is used to supply movement to the music box mechanism (B1). There is a drive mechanism (B2) between the music box mechanism (B1) and the bottom of the vertical rotating shaft (3). Thus the rotating motion of the music box mechanism (B1) imparts rotational motion in the designed direction to the rotating vertical shaft (3).

Figure 2:
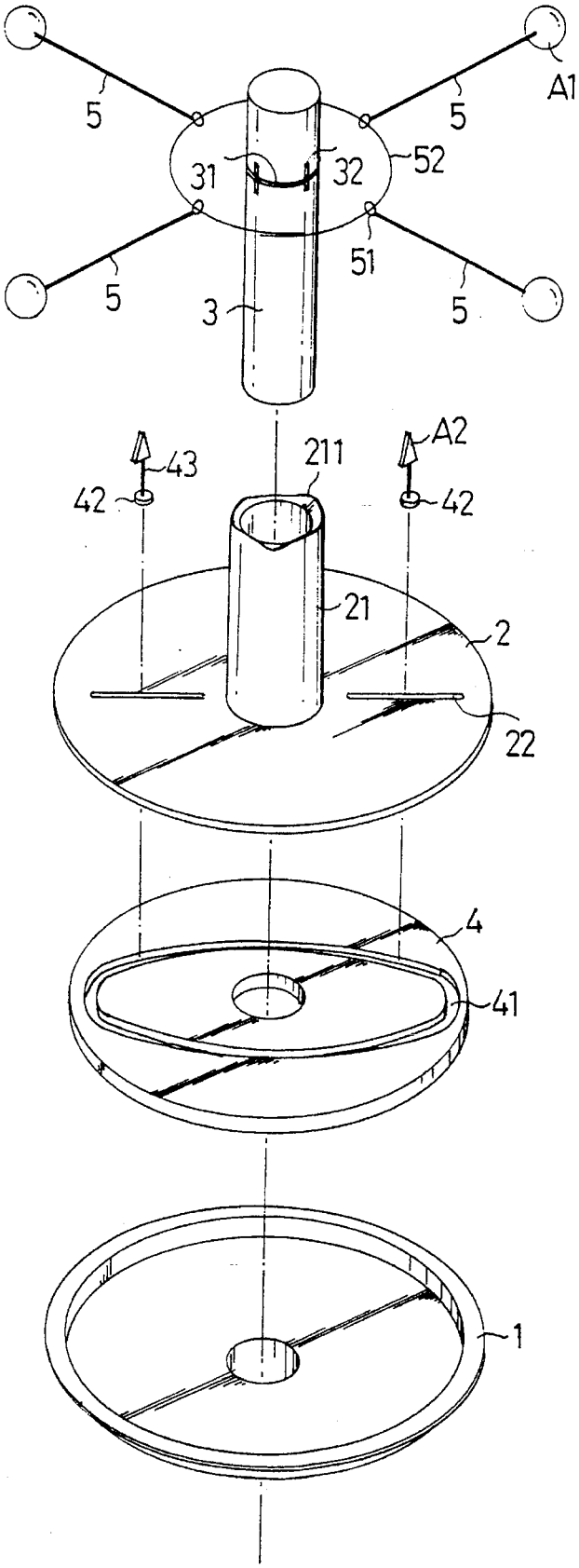
FIG. 2 is an exploded, perspective view showing the component projection of the construction.

In referencing to FIGS. 1 and 2; to the top of the aforementioned fixed base (1) is firmly attached a fixed disk (2). To the fixed disk (2) through which runs the rotating central shaft (3) is attached a fixed vertical bushing (21) which fits around a rotating shaft (3). Into the top surface or edge of bushing (21) is cut a wave or camming surface (211) which imparts an up and down or vertically reciprocal motion to a cam follower.

A number of stiff rods which act as undulating pivot arms (5) are installed within glass sphere (A). The base end of these undulating pivot arms (5) are fit to a circular pivot (51). To the outside end of the pivot arm is fastened any of a number of kinds of decorative objects (A1). The aforementioned pivot (51) is installed into a circular grove around the rotating central shaft (3) and the high and low points on camming surface (211) act to cause an undulating up and down motion of the outer ends of the undulating pivot arms (5).

Figure 3:
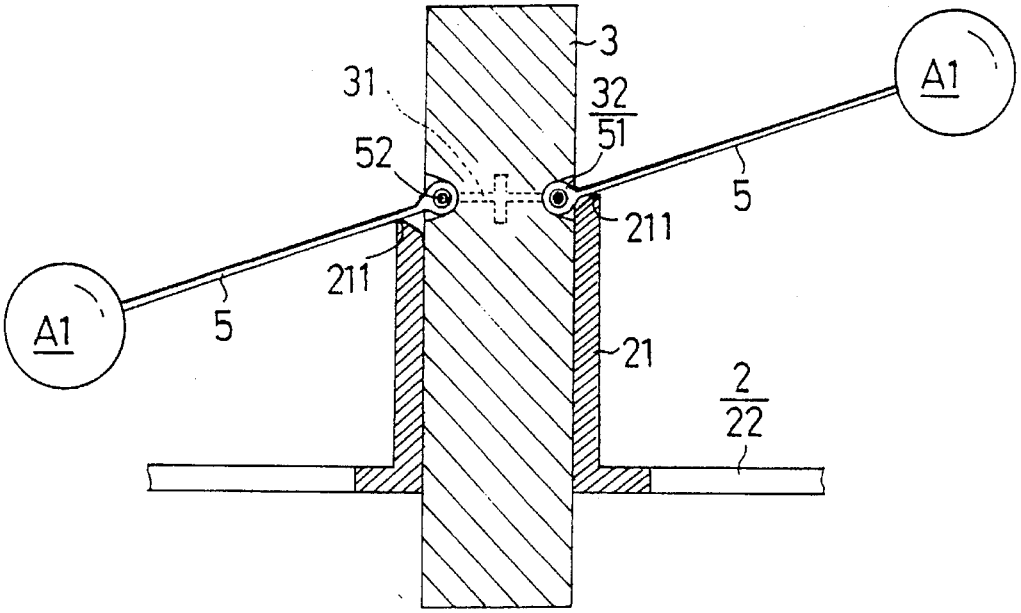
FIG. 3 is an elevational, cross sectional view of the undulating pivot arm and the central rotating shaft connecting construction.

The attachment of the pivot (51) to the periphery of the rotating central shaft (3) will now be described with respect also to FIG. 3. The circular groove (31) and the vertical grooves for the vertical slot (32) in the periphery of the above rotating central shaft (3) represented here is at the same vertical height or even with camming surface (211) of the shaft bushing (21). The circular pivot (51) fits into the vertical slot (32). The circular groove (31) contains a spring (52) on which are threaded several of the above mentioned circular pivot (51). In this fashion, the base ends of the above mentioned undulating pivot arms (5) are given a pivot point at the surface of the rotating central shaft (3) and the other end with the attached decorative object (A1) is allowed to undulate up and down as seen in FIGS. 2 and 3.

Thus, circular pivot (51) of the above mentioned undulating pivot arm (5) is adjacent to the top edge of the camming surface (211) and acts as a fulcrum for the undulating pivot rods that in turn act as levers and receive their driving force from the fixed vertical bushing (21). At the same time, the above mentioned camming surface (211) acts as a fulcrum and because of the high and low surface on its top edge, causes an up and down oscillatory motion. The central rotating shaft (3) receives its driving force from the music box mechanism (B1) while it is rotating. The above mentioned undulation pivot arms (5), besides rotating with the central rotating shaft, will receive up and down driving force from the high and low contour of the wave fringe (211) which acts as a fulcrum and supplies the up and down undulating motion to the decorative objects (A1).

In order to obtain the above mentioned up and down undulating motion of the undulating pivot arms (5), the material from which the above mentioned decorative object (A1) is constructed must have a specific gravity greater than the specific gravity of the liquid within the glass sphere (A). This insures that the undulating pivot arms (5) maintain contact with camming surface (211).

This plan is based on the driving force from the rotating motion of the central rotating shaft (3). Besides supplying the scene of the above mentioned up and down undulating motion of the undulating pivot arms (5), the same driving force from the rotating central shaft (3) can impart a different kind of motion to objects located above the fixed disk (2). The structure implementing this motion is described below with reference to FIGS. 1, 2 and 4.

The peripheral lip of the above mentioned fixed base (1) supports another fixed component, namely fixed disk (2). Between the fixed disk (2) and the fixed base disk (1) there is an empty space (C). Within this space (C) is another disk (4) which is attached to and rotates with the central rotating shaft (3). On the top surface of the above mentioned rotating disk (4) is a regular or irregular track (41). In this track (41) are placed several sliding blocks (42).

Furthermore, around the periphery of the above mentioned fixed bushing (21) there are cut several radial slots (22). Through these radial slots (22) are extended vertical extension bars (43). At the bottom end of these vertical extension bars (43) are attached sliding blocks (42) and on the top ends of these bars are attached a decorative object (A2).

Figure 4:
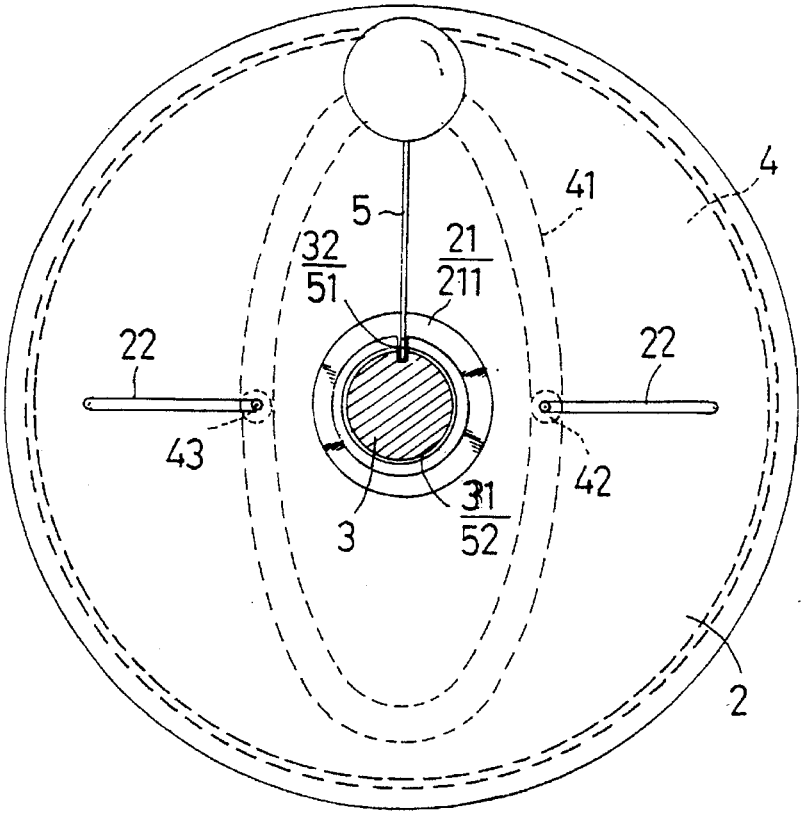
FIG. 4 is a top plan view, partially in cross-section of the track and track pill.

When the above mentioned rotating disk (4) is caused to rotate by the driving mechanism, the central rotating shaft (3), the motion of the sliding block (42) is constrained by irregular track (41) and extension bars (43) are restrained by the slots (22) while the sliding block (42) stays in the track (41). This results in a radial back and forth or reciprocal motion within the radial slots (22). As seen in FIG. 4, the decorative objects (A2) have a back and forth radial motion above the fixed disk (2).

Based on the above description, this construction derives its driving force from the rotating central shaft. Decorative objects on the ends of the undulating pivots are made to undulate up and down driven by the upper edge or camming surface of the bushing. Decorative objects are made to move in and out above a fixed disk driven by a rotating disk with a track attached to the top surface. Thus, the construction according to the present invention results in decorative objects which can be seen to have several ranges of motion within a glass sphere.

What is claimed is:

1. A crystal ball having a rotating shaft and comprising a fixed, bushing mounted concentric to the shaft, said bushing including a top surface with a high and low contour camming surface; and a plurality of pivot arms, each pivot arm having a fixed end that is pivotally connected at the circumference of said rotating shaft proximate to and engaging the top camming surface as a cam follower which causes the other end of the pivot arm to undulate in an up and down motion.

2. A crystal ball in accordance with claim 1, wherein the crystal ball contains a liquid;

and further including a decorative object on the ends of the undulating pivot arms that are not fixed, said decorative object being made of a material having a higher specific gravity than the specific gravity of the liquid which is in the glass ball.

3. A crystal ball in accordance with claim 1, wherein said rotating shaft includes a groove around the circumference thereof, said groove being adjacent to the top surface of said bushing;

and wherein said fixed end of said pivot arm includes a hub section, said hub section being is placed in the groove.

4. A crystal ball in accordance with claim 3, wherein said hub section includes a blade portion;

said crystal ball further including means for connecting said hub section to said shaft in said groove, said connecting means comprising a vertical pivot slot for receiving said hub section blade portion of a pivot arm so as to provide a fixed position of attachment, and a spring mounted in said groove, said hub section blade portion being connected to said spring.

5. A crystal ball in accordance with claim 4, wherein said pivot arms include a straight, rigid shaft portion, and wherein said blade portion is coaxially mounted to said shaft portion and comprises a circular eyelet having a bore therethrough, said spring extending through said bore.

6. A crystal ball in accordance with claim 1, wherein the rotating shaft is centrally located in the crystal ball, and wherein said pivot arms each have a straight, rigid shaft portion and a connecting portion at said fixed end rigid with said shaft portion, such that as said rotating shaft rotates, said pivot arms rotate therewith and said shaft portions ride as cam followers on said camming surface, the other end of said pivot arms thereby being driven in an undulating motion by the fulcrum action of said camming surface on said shaft portions.

7. A crystal ball in accordance with claim 1, and further including a fixed base;

a fixed disk having an orifice therein through which said rotating shaft extends, said fixed disk being mounted spaced apart from said fixed base and having a plurality of radially extending slots therethrough;

a rotating disk mounted to said rotating shaft and located in the space between said fixed base and said fixed disk, said rotating disk having an first surface that is closest to said fixed disk and having a track on said first surface;

a track follower slidingly mounted to said track;

a bar mounted at one end to said track follower and extending axially through said fixed disk slots; and an object mounted to the other end of said slot.

8. A crystal ball filled with a liquid comprising a fixed base;

a rotating shaft mounted at one portion inside said fixed base and having a circumferential groove therein at a predetermined axial distance;

a fixed disk having an orifice therein through which said rotating shaft extends, said fixed disk being mounted spaced apart from said fixed base and having a plurality of radially extending slots therethrough;

a bushing fixedly mounted to said fixed disk and extending axially along, concentric to said rotating shaft, and terminating in a top portion that is located proximate to said circumferential groove, said top portion having an upper camming surface;

a plurality of pivot arms, each pivot arm comprised of a pole portion having a fixed end and a second end, and a hub portion rigidly connected to said pole portion fixed end;

means for pivotally attaching said pivot arm hub portion to said rotating shaft such that a portion of said pivot arm engages said camming surface as a cam follower, said pivotally attaching means comprising a spring wire mounted in said circumferential groove, and an orifice in said hub portion through which said spring wire extends;

a rotating disk mounted to said rotating shaft and located in the space between said fixed base and said fixed disk, said rotating disk having an first surface that is closest to said fixed disk and having a track on said first surface;

a track follower slidingly mounted to said track;

a bar mounted at one end to said track follower and extending axially through said fixed disk slots; and an object mounted to the other end of said slot.

* * * * *